United States Patent [19]

Lewis, Jr.

[11] 4,015,660

[45] Apr. 5, 1977

[54] SUBSEA OIL AND GAS PRODUCTION MANIFOLD SYSTEM

[75] Inventor: Harry R. Lewis, Jr., Chicago, Ill.

[73] Assignee: Standard Oil Company (Indiana), Chicago, Ill.

[22] Filed: Dec. 16, 1975

[21] Appl. No.: 641,216

[52] U.S. Cl. ..... 166/.5; 137/625.11; 137/236

[51] Int. Cl.[2] ..... E21B 43/01

[58] Field of Search ..... 166/.5, 70; 137/625.11, 137/236; 239/22, 23; 15/104.06 A

[56] References Cited

UNITED STATES PATENTS

| | | | |
|---|---|---|---|
| 1,413,505 | 4/1922 | Stump | 193/23 |
| 3,116,503 | 1/1964 | Bagwell | 15/104.06 A |
| 3,312,282 | 4/1967 | Yetman | 166/.5 X |
| 3,542,125 | 11/1970 | Sizer | 166/.6 |
| 3,545,474 | 7/1968 | Brown | 166/70 X |
| 3,545,489 | 7/1968 | Brown | 166/70 X |
| 3,674,123 | 7/1972 | Lewis et al. | 166/70 |

*Primary Examiner*—Ernest R. Purser
*Assistant Examiner*—Richard E. Favreau
*Attorney, Agent, or Firm*—John D. Gassett

[57] ABSTRACT

This invention covers a subsea manifold for selectively connecting a transport line to one of a plurality of subsea production lines leading to subsea wells which are drilled in the ocean floor for the production of oil and gas. It includes a pie-shaped enclosed container with a plurality of well line inlets arranged in an arc on the inside of the container, a flow passage in the apex of the container, and a hollow flexible arm connects at one end to the flow passage and the other end is extendible to be moved from one to a selected one of the well line inlets. Due to the enclosed nature of the hollow flexible arm and enclosed arrangements, the flexible arm is not required to make a tight seal with any of the well line inlets. Individual well testing and routing of pumpdown tool (PDT) is permitted.

5 Claims, 5 Drawing Figures

SUBSEA OIL AND GAS PRODUCTION MANIFOLD SYSTEM

BACKGROUND OF THE INVENTION

1. Field of the Invention

This invention relates to a subsea manifold system for selectively connecting a production line leading from a surface location remote from the manifold to one of a plurality of well lines leading to subsea oil and gas wells. In the environment in which this will be used, there will be many wellheads at spaced-apart locations from each other, for wells completed in the ocean floor. Production lines from each of these subsea wellheads will extend to the subsea manifold. Only one production line and one set of service lines will run from the manifold to the surface of the body of water.

2. Setting of the Invention and Prior Art

A large amount of the drilling of oil and gas wells is done in offshore water-covered areas. In the shallower water, wells are drilled and produced from platforms supported above the surface of the body of water by piles extending into the bottom of the water. In this system, drilling and production is carried on much like it is onshore. However, as the water depths become deeper, it becomes increasingly uneconomical to build such fixed platforms. Drilling of oil and gas wells is now being contemplated in water up to 1000 feet, or more. In one method of production, it is contemplated the wells will be drilled in the ocean floor and that the wellhead will be at the ocean floor instead of on the platform above the surface of the body of water. When wells are completed with the wellheads on the ocean floor, various means must be provided for lifting the oil and gas to the surface so that it may be utilized. One such system is described in U.S. Pat. No. 3,542,125, Phillip S. Sizer, inventor, issued Nov. 24, 1970. That patent describes a subsea wellhead system for servicing a plurality of wells having well-heads which are spaced apart and supported on a submerged platform. It includes a movable latch head selectively connectable with any one of the wellheads. The flow conductors connected to the outlet end of the latch head go to a remotely controlled location so that a workover tool, such as through the tubing (or pumpdown tools [PDT]) can be used. The wellheads to which the latch head is selectively connected will determine to which of the subsea wells the PDT tools are pumped. Thus, the movable latch head is selectively connected to the wellhead of the well which is to be serviced. Well tools are then pumped from a remote location service station through a latch head, to the selected wellhead, and to the selected well. A flow conductor is connected between the movable latch head and remotely located controlling service station. In the system of U.S. Pat. No. 3,542,125, the latch head must make a seal-tight connection with the selected wellhead. Applicant has disclosed a system whereby a sealing connection is not necessary.

Another patent of interest is U.S. Pat. No. 3,674,123, George E. Lewis, issued July 4, 1972. That patent relates to an apparatus enabling controllable diversion of tool passage between multiple pipes connectible with a single pipe and includes a housing forming a primary port in communication with a primary pipe to pass a pumpdown tool. The housing also forms a series of secondary ports respectively communicable with multiple secondary pipes selected to pass the tool. The rotor for driving the connector duct 21 and the housing is constructed so that the rotor is pressure balanced endwise. The connector duct within the housing is curved and is of a rigid configuration. These present features and accompanying problems which are not found in the present invention.

BRIEF SUMMARY OF THE INVENTION

This invention concerns a subsea manifold and related apparatus for selectively connecting a transport line to one of a plurality of production well lines leading to subsea wells. The manifold itself comprises an enclosed wedge-shaped container adapted to rest upon the ocean floor. The wedge-shaped container might be characterized as pie-shaped and at the apex there is a connection for a transport line. On the outlet end of the container is a plurality of well-line inlets, which are arranged in an arc on the inside of the container. The apex of the container has an outlet passage which is at the approximate center of a circle defined by the arc. Within the container is a hollow, flexible arm having a first end connected to the passage in the apex of the container and the other end movable and extendible to said arc. Means are provided to move the other end of said flexible arm angularly to a selected well-line inlet.

Each well-line inlet is connected to a production line leading to a subsea wellhead. This production line has a "Y" connection near the container. One leg of the line goes to a control valve to the well-line inlet of the container and the other leg of the line leads to a second control valve connected to a common production manifold. These valves are all controllable from the surface. By proper manipulation of the valves, production tests can be had on each of the wells individually through the manifold hookup.

To use pumpdown tools in wells, there must be a dual conduit going to the vicinity or level in the well to which the pumpdown tool is to be pumped. This is necessary so that the tools can be retrieved. A separate service manifold having a plurality of outlets with valves is provided so that a separate connection from each outlet can be made to each individual well. A fluid under pressure is provided to the manifold and the valves are controlled from the surface. Thus, one can select which well should be supplied with a fluid under pressure to return the pumpdown tool.

A better and more complete understanding of the invention can be had from the description which follows taken in conjunction with the drawings.

DESCRIPTION OF PREFERRED EMBODIMENTS IN CONJUNCTION WITH THE DRAWINGS

Figure 1:
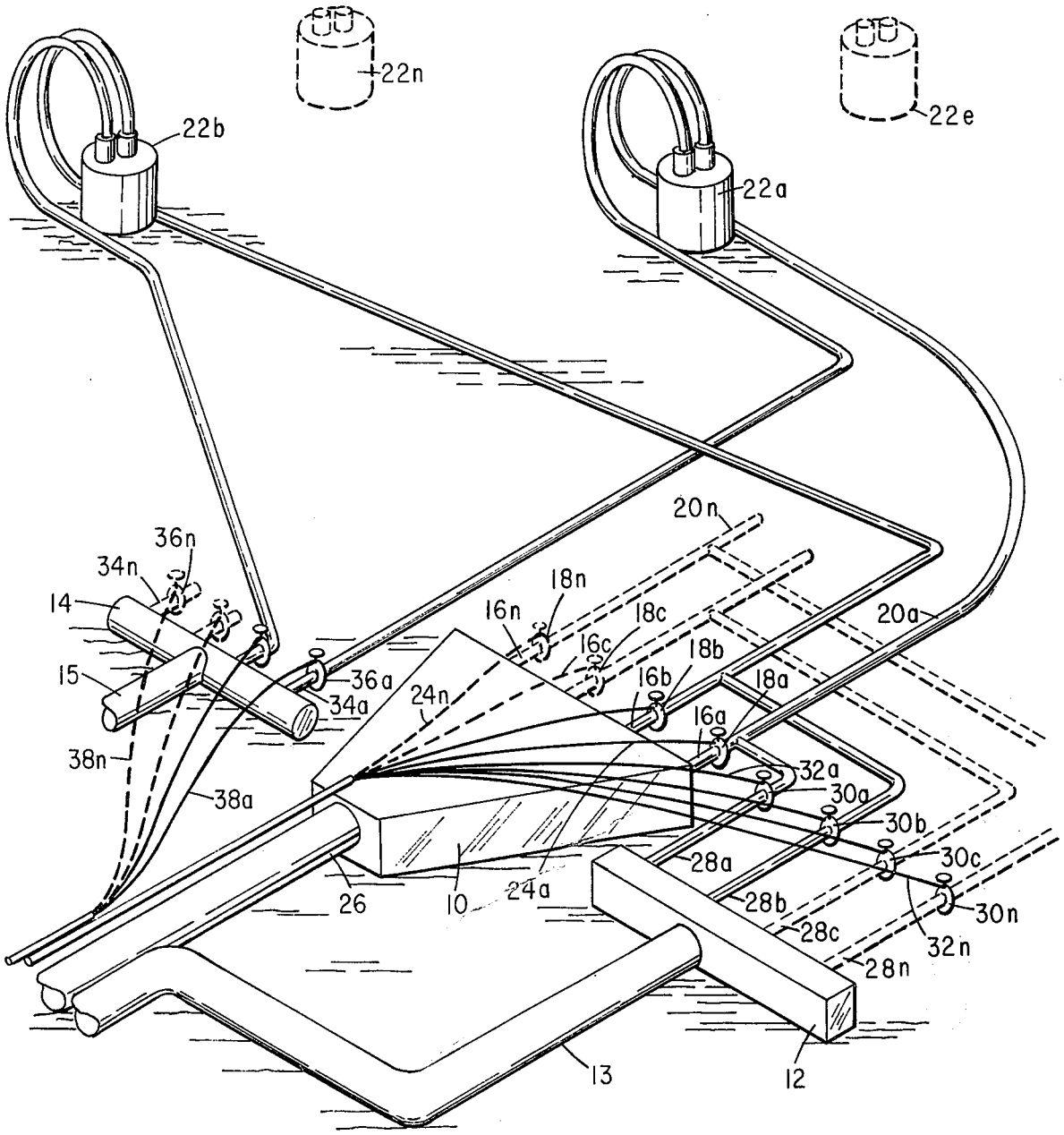
FIG. 1 is a plan view of the manifold and related assembly on the ocean floor.

FIG. 1 shows the subsea manifold and its associated setting. Shown there is the main switching manifold 10, production manifold 12, and service manifold 14, which has an inlet 15 for use in supplying fluid under proper pressure. As can be seen, switching manifold 10 includes a completely enclosed wedge-shaped container having a plurality of well inlets 16*a* to 16*n*. These well inlets are connected to valves 18*a* to 18*n*, respectively. These valves are connected to well production lines 20*a* to 20*n*, which lead to underwater wellheads 22*a* to 22*n*. Each control valve, 18*a* to 18*n* is provided with a control line 24*a* to 24*n* which extend to a remote location where the various valves can be opened or closed remotely and selectively. Switching manifold 10 has an outlet at its apex connecting to transport line 26 which leads to a remote surface control location. The switching mechanism within switching manifold 10 for connecting passge 26 with a selected well inlet 16*a* to 16*n* will be discussed later.

Production manifold 12, which is an elongated enclosed vessel, has a series of production inlet lines 28*a* to 28*n* provided respectively with valves 20*a* to 30*n*. These lines are connected to well production lines 20*a* to 20*n*, respectively. These valves 30*a* to 30*n* are provided with control lines 32*a* to 32*n* which extend to a remote control location where the valves can be selectively opened and closed individually. Production manifold 12 has an outlet connected to the primary production transport line 13 which leads to the selected remote surface location where storage or other transport means are provided.

Also shown in FIG. 1 is a service manifold 14 having a plurality of outlets 34*a* to 34*n*. Outlets 34*a* to 34*n* have control valves 36*a* to 36*n*, respectively, which also have control lines 38*a* to 38*n*, which extend to a remote control location so that the wells can be selectively closed or opened. These outlet lines extend down the wells to a level necessary for pumpdown tool operations.

Figure 2:
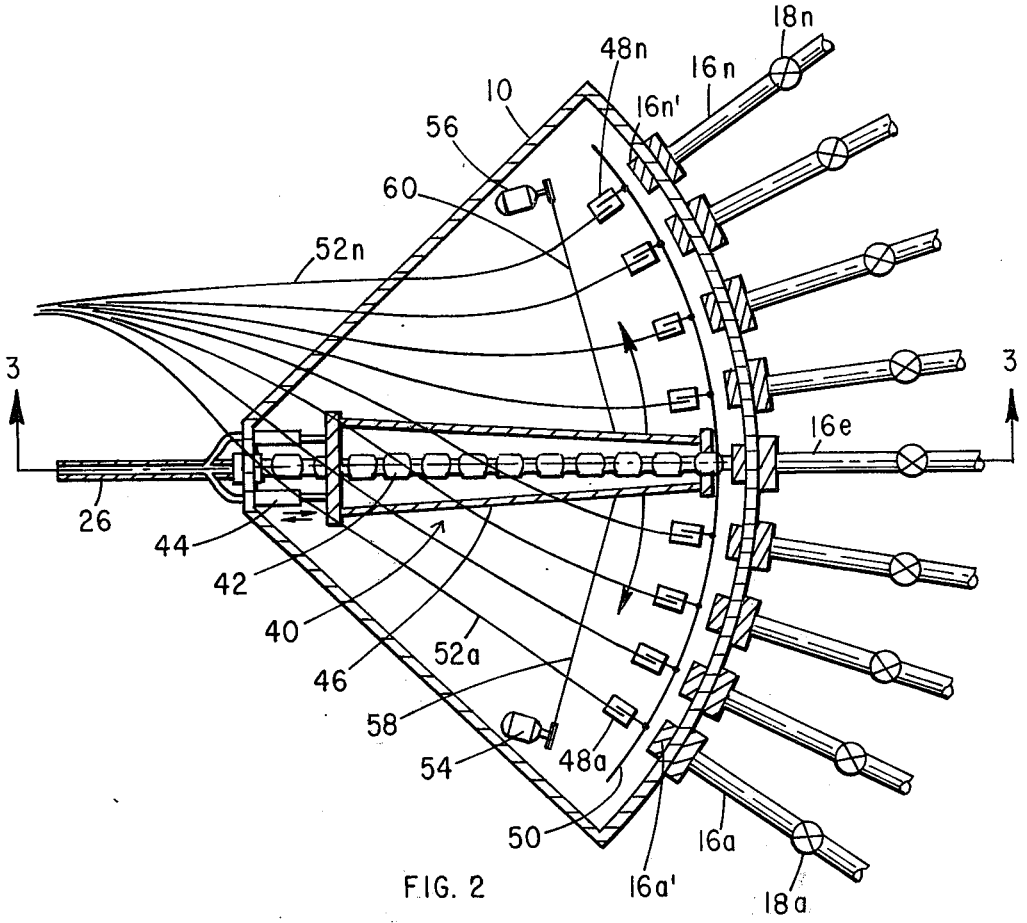
FIG. 2 is a view, mostly in section, through the container of FIG. 1 taken along the line 2—2 of FIG. 3.

Attention is next directed to FIG. 2 for a view at the inside of container 10. There is shown flexible arm 40. This arm includes tandem-connected flex joints 42, hydraulic rams 44, and mechanical linkage assembly 46. The tandem-connected flex joints 42 make a hollow connecting arm which connects at its apex end with passsage 26 and at its outlet end selectively with the well inlet 16*a*′ to 16*n*′. It is shown connected to inlet 16*e*.

Attention will next be directed to that part of FIG. 2 which permits remote determination of the position of hollow flex arm 42. This includes a plurality of switches 48*a* to 48*n*. One terminal of each switch is connected to a ground 50 and the other to its respective lead 52*a* to 52*n*, respectively. These leads 52*a* to 52*n* all lead to a remotely controlled location so that the position of the switching arm 42 can be determined. Rams 44 are used to either force the end of arm 42 to inlet 16*e* or to remove it therefrom. When the arm is removed from the inlet 16*a*, it can be rotated along the arc of housing 10 to whichever position is desired. Simple means can be used to effect this rotation. It includes a first motor 54 and a second motor 56. These motors have lines 58 and 60, respectively, which are used to rotate the arm to its desired location. Once the arm is rotated to the desired location, as indicated by switch 48, hydraulic rams 44 are energized to shove the flexible arm into engagement with the selected one of inlets 16*a* to 16*n*. Means for operating rams 44 are shown but such means are well known and can be done in any conventional manner.

Figure 3:
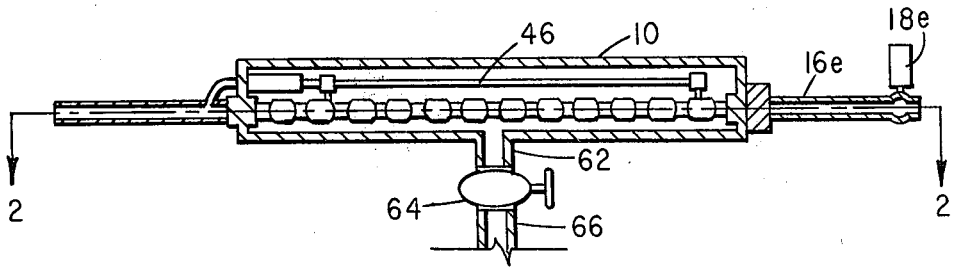
FIG. 3 is a view mostly in section taken along the line 3—3 of FIG. 2.

Attention is directed to FIG. 3 which illustrates a side view along the line 3—3 of FIG. 2. There is also shown a bottom drain 62 having control valve 64, and a clean-out line 66.

Figure 4:
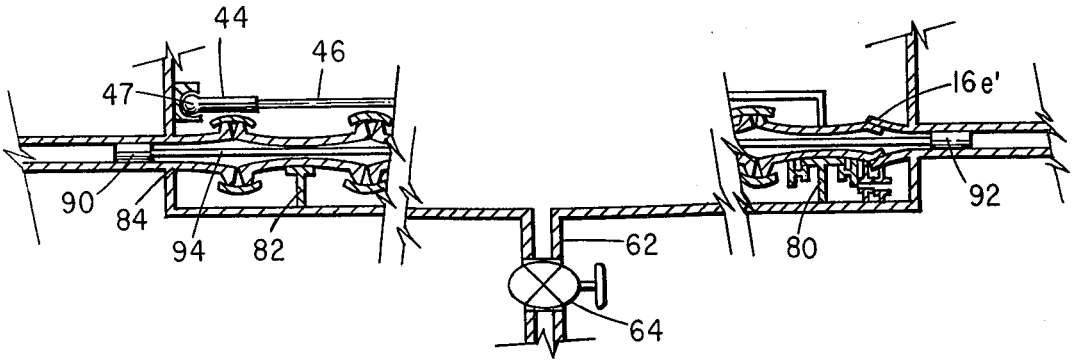
FIG. 4 is similar to FIG. 3 except it shows in more detail the nature of one embodiment of the flexible arm.
Figure 5:
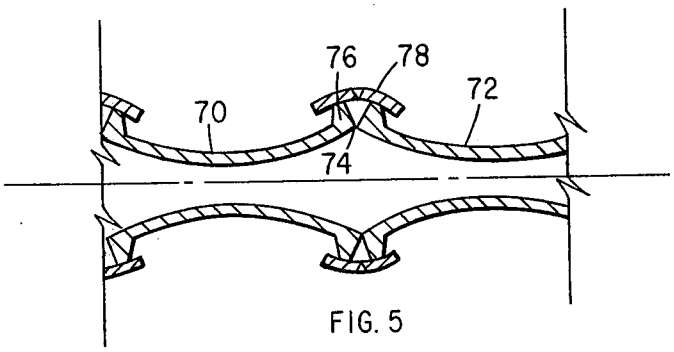
FIG. 5 shows one arrangement of flexible joints of the flexible coupling of FIG. 3.

Attention is next directed to FIGS. 4 and 5, which show details of the mechanism which makes up one embodiment of the connecting arm. A very important aspect of this invention is the fact that the flex joints and connections of the movable end of the flex arm need not be pressure-tight connections. The reason for this is that they are completely within container 10 and the fluid within container 10 is normally produced well fluid and may be at the same pressure as fluid in the flex arm. In FIG. 5, there are shown two curved portions 70 and 72 which have a curved portion coming to an end having a flared lip 76, which contacts circumferential point 74, although it is not necessary that joints 72 and 74 contact. A ring 78 is fitted over flared members 76 to keep them from separating, yet maintaining a flexible joint. The joints are made with adequate clearances for the arm 42 to be flexible and to be radially or longitudinally extended and contracted. FIG. 4 also shown arcuate supports 80 and 82 for the end of the flex joint so that they will ride smoothly about the arc which is defined by the inlet line 16*a*′ to 16*n*′. The other end of the flex arm is at the apex 84 which is really the center of the circle defined by the arc. Rams 44 are provided with a ball joint 47 so that they can freely rotate as necessary as the arm is moved from one position to the other. Shown in FIG. 4 is a pumpdown tool 90 designed such that its first locomotive or power piston 93 is through the flex session before the second locomotive 90 enters the flex joint. Arm 94 connects the locomotives 90 and 92.

In normal production operations, the device would be operated with valves 18*a* to 18*n* of the switching manifold and valves 36*a* to 36*n* in the service manifold all closed. Production would come from the wells through lines 20*a* to 29*n*, through valves 30*a* to 30*n*, which are open, and to production manifold 12. There, they would go through line 13 to surface oil or production storage means. Should it become necessary to pumpdown a workover or other tool in one of the wells, such as well 22*c*, valve 30*e* would be closed and valve 18*e* opened. The flex arm 42, as shown in FIG. 2, would be moved to its position where switch 48*e* is closed. At that time, the rams 44 would be energized to drive arm 42 so that the end is engaged with inlet 16*e*′, as shown in FIG. 4. The pumpdown tool is then inserted at the surface through conventional equipment and driven through line 26 through the flexible arm 42 and down line 20*e* of well 22 to a preset level selected in a known operational procedure, to where it services in a normal manner. When it is desired to retrieve the pumpdown tool, valve 36*e* is opened and return fluid pressure is then injected into well 22*e* in the usual manner of retrieving pumpdown tools. Well 22*e* is returned to production by closing valves 36*e* and 18*e* and opening valve 30*e*.

The apparatus of FIG. 1, can also be used for giving an individual production test for a selected well. What occurs when this is desired is to move the flexible arm to the selected position corresponding to the selected well. This is done in the same manner as used for the pumpdown tool. Then, one of the valves 18*a* to 18*n* for the selected well is opened and the corresponding selected one of valves 30*a* to 30*n* closed.

If container 10 should need cleaning out, it may be easily accomplished with the system I have. Valves 18*a* to 18*n* are closed and valve 64 is opened and hot cleaning fluid or other cleaning fluid is circulated down valve line 26 to container 10 and out through outlet 62, and is collected in a suitable container, not shown.

While the above description has been done in detail, various modifications can be made thereto without departing from the spirit or scope of the invention.

I claim:

1. A subsea maifold system for selectively connecting a transport line to one of a plurality of well lines from underwater wells, which comprises:

an enclosed wedge-shaped container, a plurality of well-line inlets arranged in an arc on the inside of said container, a passage in said container at the approximate center of a circle defined by said arc, said passage connected to said transport line, a hollow, flexible arm having a first end connected to said passage and the other end extendible to and retractable from said arc, and means to move said other end of said flexible arm to a selected well-line inlet, including means to extend and to retract radially said other end of said flexible arm to and from said inlet.

2. A subsea manifold system for selectively connecting a transport line to one of a plurality of well lines from underwater wells, which comprises:

an enclosed wedge-shaped container, a plurality of well-line inlets arranged in an arc on the inside of said container, a passage in said container at the approximate center of a circle defined by said arc, said passage connected to said transport line, a hollow, flexible arm having a first end connected to said passage and the other end extendible to said arc, means to move said other end of said flexible arm to a selected well-line inlet, a production line leading from each said underwater well to each of said well-line inlets and each having a remotely operated first control valve near said well-line inlet, a production manifold having a plurality of production inlet lines, each such line having a remotely operated control valve therein, each of said production inlet lines connected to one of said production lines between the well and said first control valve adjacent said well-line inlets to said container, and a primary production transport line from said production manifold to a remote location.

3. A system as defined in claim 2 in which said container has a drain line in the lower portion with a remotely controlled valve.

4. A system as defined in claim 2 in which each well has a pumpdown tool service tubing, including:

a service manifold having a plurality of outlets, each said outlet having a remotely operated control valve, a service line connected to service tubing in each said well, and a line connecting each said outlet of said service manifold to one of said service lines.

5. A system as defined in claim 4, including a pumpdown tool having two locomotives, the distance from between said locomotives being greater than the distance from the apex of said container to its arc.

* * * * *

UNITED STATES PATENT OFFICE

CERTIFICATE OF CORRECTION

PATENT NO. : 4,015,660

DATED : April 5, 1977

INVENTOR(S) : Harry R. Lewis, Jr.

It is certified that error appears in the above-identified patent and that said Letters Patent are hereby corrected as shown below:

Column 3, line 19, "20a" should be --30a--;
line 66, "rams 44 are shown" should read --rams 44 are not shown--.

Column 4, line 22, "shown" should be --shows--;
line 31, "piston 93" should be --piston 92--;
line 39, "29n" should be --20n--;
line 44, "22c" should be --22e--;

Column 5, line 11 (Claim 1), "maifold" should be --manifold--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*